US005515994A

United States Patent [19]

Goglio

[11] Patent Number: 5,515,994

[45] Date of Patent: May 14, 1996

[54] DEGASSING VALVE FOR AROMATIC PRODUCTS, SUCH AS COFFEE AND SIMILAR PRODUCTS

[76] Inventor: Luigi Goglio, Via Frua, 11, 20146 - Milan, Italy

[21] Appl. No.: 261,323

[22] Filed: Jun. 16, 1994

[30] Foreign Application Priority Data

Dec. 23, 1993 [IT] Italy ..... MI93A2721

[51] Int. Cl.[6] ..... B65D 51/16

[52] U.S. Cl. ..... 220/372; 220/371; 426/118

[58] Field of Search ..... 220/371, 372; 312/31; 422/40, 101, 122; 426/118, 124, 395

[56] References Cited

U.S. PATENT DOCUMENTS

| | | | |
|---|---|---|---|
| 3,243,071 | 3/1966 | Kimmel . | |
| 3,595,467 | 7/1971 | Goglio | 229/62.5 |
| 3,799,427 | 3/1974 | Goglio | 426/118 |
| 3,949,934 | 4/1976 | Goglio | 426/118 |
| 4,000,846 | 1/1977 | Gilbert | 426/118 |
| 4,134,535 | 1/1979 | Barthels | 426/118 |
| 4,210,255 | 7/1980 | Pan | 426/118 |
| 4,890,637 | 1/1990 | Lamparter | 426/118 |
| 4,966,780 | 10/1990 | Hargraves | 426/118 |
| 4,980,132 | 12/1990 | Stinson | 220/371 |

FOREIGN PATENT DOCUMENTS

| | | | |
|---|---|---|---|
| 0296437 | 12/1988 | European Pat. Off. . | |
| 0373833 | 6/1990 | European Pat. Off. . | |
| 0519168 | 12/1992 | European Pat. Off. | 220/371 |
| 2233232 | 1/1975 | France . | |
| 2593264 | 7/1987 | France . | |
| 2731917 | 2/1979 | Germany | 426/124 |
| MI91A001770 | 6/1991 | Italy . | |
| 0012010 | 1/1980 | Japan | 426/118 |
| 0124579 | 5/1991 | Japan | 426/118 |

*Primary Examiner*—David Scherbel
*Assistant Examiner*—Randall E. Chin
*Attorney, Agent, or Firm*—Oblon, Spivak, McClelland, Maier & Neustadt

[57] ABSTRACT

A one-way degassing valve (4) for aromatic products, such as coffee and the like, comprising a valve body (5,6), a valve element (12) and a selective type filter (17, 170), preferably consisting of activated charcoal which allows the passage of low molecular weight gases, such as carbon dioxide, and retains the high molecular weight gases that constitute the product's aroma.

6 Claims, 1 Drawing Sheet

FIG. 3
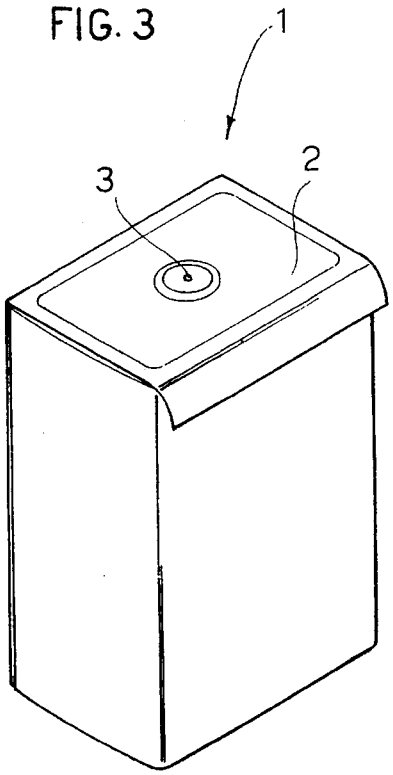
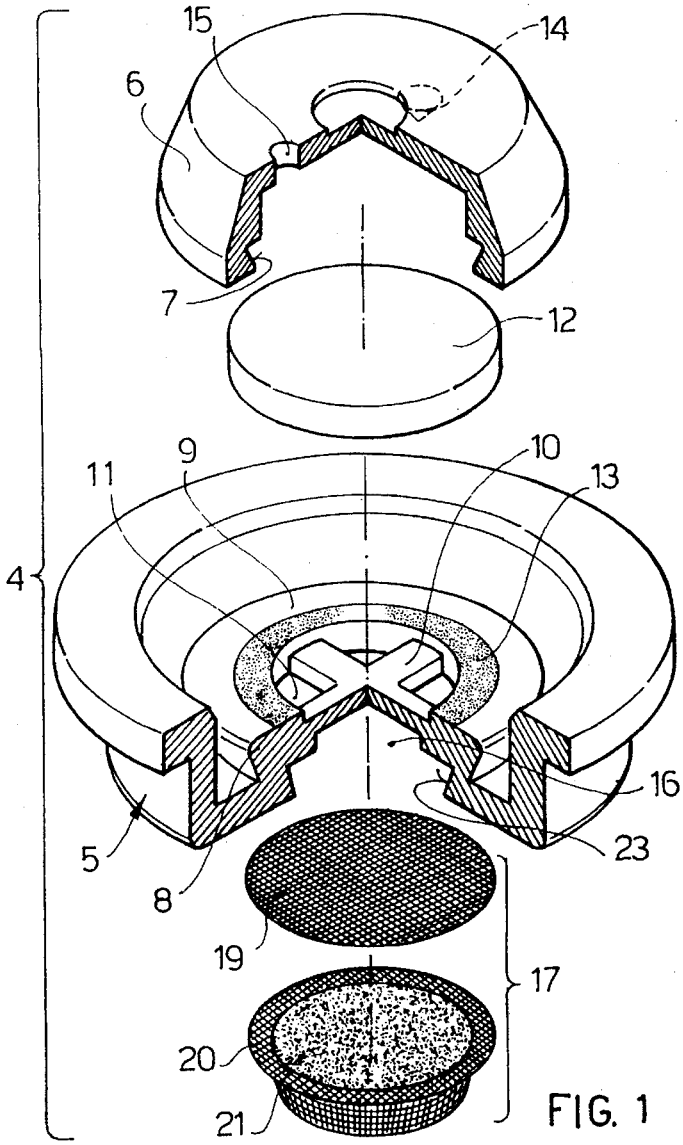
FIG. 1
FIG. 4
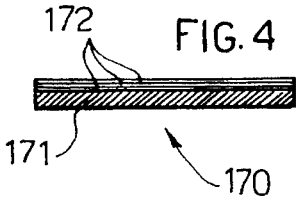
FIG. 2
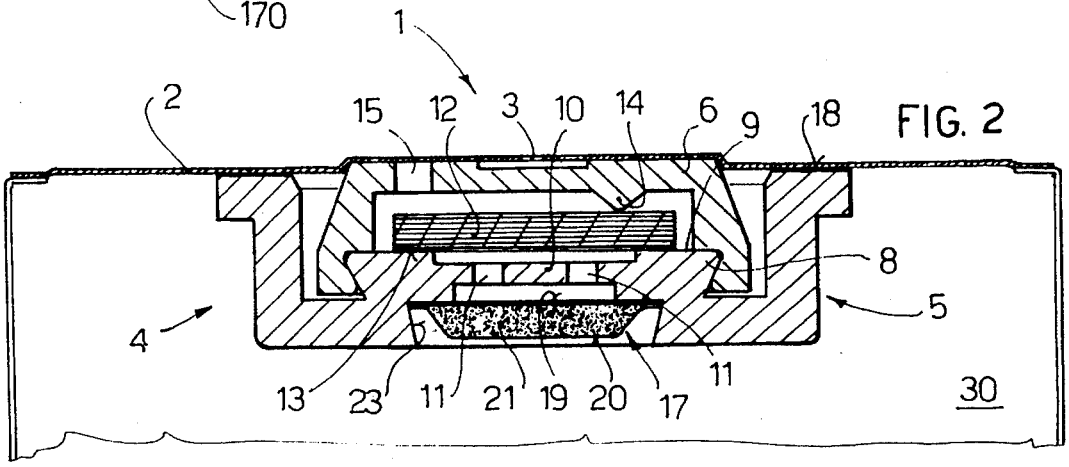

DEGASSING VALVE FOR AROMATIC PRODUCTS, SUCH AS COFFEE AND SIMILAR PRODUCTS

BACKGROUND OF THE INVENTION

1. Field of the Invention

The present invention relates to a valve for aromatic products, or products that develop fragrant gases, particularly powder-like products such as coffee and the like, packaged in air-tight containers. Specific reference will be made hereafter to coffee, it being understood that what is said applies in general to all those products that develop fragrant gases.

2. Discussion of the Background

Valves of the above mentioned type are obviously already known and are commonly called degassing valves. They are one-way valves that are normally applied to the upper wall of the container and whose purpose it is to allow the gases developed by the coffee to escape from the container—thus avoiding the possible build-up of internal overpressures which would cause swelling and/or breakage of the container itself—and at the same time to prevent air from entering the container as this would impair the quality of the product.

The one-way valves used at present serve this purpose perfectly, opening when slight internal overpressures occur and closing immediately when they cease.

However, these valves present great drawbacks due to the following considerations.

Fresh (newly packaged) coffee generates a mixture of gases inside the container, consisting mainly of carbon dioxide and, a smaller percentage of aromas, which are characterized by complex molecular chains and thus have a high molecular weight.

The one-way valves currently used employ porous filters, whose sole purpose is to prevent the escape of coffee grounds (i.e. solid components of the coffee). In the event of overpressure inside the container, therefore, they allow both carbon dioxide and the product's aromas to escape through the valve.

SUMMARY OF THE INVENTION

The aim of the invention is to avoid this drawback and to preserve the aroma of the product virtually intact, preventing any escape of the aromas, i.e. of gaseous components with a long molecular chain.

This aim is achieved, according to the invention, by providing a degassing valve equipped with a selective filter, that allows the passage of molecules of carbon dioxide and any other gases, such as oxygen, nitrogen and methane, and traps the molecules that determine the product's aroma, which then fall back inside the container, thus enhancing the quality of the product.

Porous molecular separators or sieves can be used as selective filters. However, in the tests carried out, it has been observed that the filters that best perform this selector function are compounds based on activated charcoal. This is presumably due to the fact that these activated charcoals, whether of a vegetable or natural type, are obtained through pyrolysis, a similar operation to that which takes place during coffee roasting.

These activated charcoals can be used alone or mixed with other substances so as to accomplish more particular specific tasks, for example acid substances such as citric acid that neutralize basic gases or, vice versa, basic substances such as sodium hydroxide, that neutralize acid gases.

BRIEF DESCRIPTION OF THE DRAWINGS

Further characteristics of the invention will be made clearer by the detailed description that follows, referring to a purely exemplary, and therefore non-limiting embodiment, illustrated in the appended drawings, in which:

FIG. 1 is a schematic view of a degassing valve equipped with a selective filter according to the invention;

FIG. 2 is a schematic sectional view of the valve in FIG. 1 installed on a container, shown partially;

FIG. 3 is a schematic axonometric view of the container equipped with such a valve; and FIG. 4 is a schematic sectional view of a different embodiment of the valve filter.

DESCRIPTION OF THE PREFERRED EMBODIMENTS

With reference to these figures, in FIG. 3, reference number 1 indicates generally a container for aromatic products, particularly coffee, of the flexible or semi-rigid type, for example of the type described in Italian patent application MI-91A001770.

In the example illustrated, at the top of the container there is a peelable diaphragm 2 that is removed on opening the container, which can then be closed again by means of a lid not shown in the figure.

The peel-off diaphragm 2 has a hole 3, beneath which is applied a degassing valve indicated as a whole by reference number 4, this valve being heat-welded or glued to the sheet 2.

The degassing valve 4, whose general structure can be considered as being substantially known, comprises a base plate 5 and a cap 6 seated in it. The cap 6 has an annular groove 7 near its lower edge that engages with a corresponding annular projection 8 provided on the bottom of the plate 5. Above the projection 8 a flat annular wall 9 is foreseen, which surrounds a central disk 10 provided with holes 11.

Between the cap 6 and the plate 5 is interposed a rubber diaphragm 12, acting as an actual valve, the peripheral part of which rests on said flat annular wall 9 of the plate, which is spread with a viscous or sticky layer 13, in order to provide a better seal. The diaphragm 12 is pressed against the plate 5 by a contrasting projection 14 provided in the top wall of the cap 6, in which an air-hole 15 is also provided.

The bottom of the plate 5 is shaped so that underneath it, below the disk 10, a housing 16 is provided for a filter 17 that will be described in greater detail below.

The valve 4 is fixed to the sheet 2 by welding or gluing that follows an annular course 18 along the upper outside edge of the plate 5.

The valve works as follows.

Under normal conditions the robber diaphragm 12 is pressed against the flat wall 9 of the plate 5 and, also thanks to the presence of the sticky or tacky layer 13, provides a seal both against the escape of the gases from inside the container 1 and against the entry of air from the outside.

In the event of overpressure inside the container 1, the diaphragm 12 lifts from the wall 9, allowing the gases to escape, passing into the outside environment through the holes 11, the space that is created between the diaphragm 12 and the wall 9, the hole 15 in the cap 6, and the hole 3 in the peel-off sheet 2. When normal conditions are restored, the diaphragm 12 comes down again, preventing air from entering the container by the opposite route to that previously described.

In order to prevent the coffee aromas from escaping too when gases are being discharged from the container, a selective type filter 17 is used.

In the preferred embodiment, illustrated in FIGS. 1 and 2, the filter 17 comprises two layers of porous paper 19, 20, between which is disposed an activated charcoal powder 21. The two layers of paper 19 and 20 are glued together along their outer edge, and the whole filter 17 can then be glued or heat-welded, along its peripheral edge 22, to the inside of the housing 16 of the plate 5. If the housing 16 has a slightly sloping side wall 23, so that its mouth is narrower, as shown in FIGS. 1 and 2, the filter 17 is automatically retained inside the housing, without any need for further fixing means.

With this filter structure, the gases given off by the coffee, before passing through the rubber diaphragm (12), are filtered through the activated charcoal 21, which traps some of the gases, namely those with long molecular chains, thus absorbing and enriching itself with the aromas.

Once the coffee has stopped giving off gas, these aromas remain trapped at a high concentration in the activated charcoal.

Thus there is a very small volume (essentially that of the filter 17) with a high concentration of aromas, separated from the outside environment and upon communication of the high concentration of aroma or the inside environment, i.e. the headspace 30 of the container 1, the aromas are diluted so as to have a lower concentration of aromas than before. In other words, the gas concentration in the headspace 30 is lower than the gas concentration in the filter volume where the gases are trapped.

There is inherently a pressure difference between the volume of the filter 17 and the headspace of the container due to the gas trapped with filter as described above and in order to restore the pressure balance, the gases trapped in the filter will subsequently flow back inside the container, enriching the gas with the aromas which can also penetrate the coffee alveoli, thus increasing the concentration of these gases in the coffee and providing clear advantages.

The activated charcoals 21 in the filter 17 can be mixed with other substances, for example acid substances such as citric acid that neutralize basic gases, or basic substances such as sodium hydroxide, which neutralize acid gases.

FIG. 4 shows a different embodiment of the filter, indicated by 170, according to which it comprises a single sheet of porous paper 171, on which is spread at least one layer 172 of activated charcoal previously mixed with excipients such as water and sugar, for example.

FIG. 4 shows a plurality of layers 172, each of which can perform specific functions, such as neutralizing basic or acid gases, for example.

Obviously the valve according to the invention can be applied to flexible, air-tight bags or containers of any type to contain all those products which give off odors that must not be allowed to contaminate the outside environment.

I claim:

1. A degassing valve for a product which produces an aroma, comprising:

a valve body, a one-way valve element positioned on the valve body, and a filter engaging said valve body, said filter preventing the passage of solid components of said product and allowing passage of a gas produced by said product, said gas being selected from the group consisting of carbon dioxide, oxygen, nitrogen and methane and retaining in said filter longer molecular chain gases which comprise the aroma of the product wherein said filter comprises one of activated charcoal and activated charcoal mixed with another substance.

2. A valve according to claim 1 wherein the filter comprises two opposite layers of porous paper, wherein said activated charcoal is contained between said layers of porous paper.

3. A valve according to claim 1 wherein the filter comprises a sheet of porous paper, wherein said activated charcoal is mixed with excipients and spread in at least one layer on said sheet of porous paper.

4. A valve according to claim 1, which comprises a housing located in said valve body wherein said filter is contained in said housing.

5. A degassing valve according to claim 1 which comprises a container which has a wall wherein said container contains said product and said valve body is connected to the wall of the container for said product that give off the gas and aroma.

6. A valve according to claim 5, wherein said wall comprises a sheet that closes the container.

* * * * *